US006152749A

United States Patent [19]

Tseng et al.

[11] Patent Number: 6,152,749

[45] Date of Patent: Nov. 28, 2000

[54] CARD EDGE CONNECTOR

[75] Inventors: Jong Tseng, Tu-Chen; Yuh-Huey Kang, Pan-Chiao, both of Taiwan

[73] Assignee: Hon Hai Precision Ind. Co., Ltd., Taipei Hsien, Taiwan

[21] Appl. No.: 09/386,890

[22] Filed: Aug. 31, 1999

[30] Foreign Application Priority Data

Jun. 17, 1999 [TW] Taiwan ..... 88210076

[51] Int. Cl.[7] ..... H01R 13/62

[52] U.S. Cl. ..... 439/160

[58] Field of Search ..... 439/152–160, 439/327, 372

[56] References Cited

U.S. PATENT DOCUMENTS

| | | | |
|---|---|---|---|
| 5,364,282 | 11/1994 | Tondreault | 439/157 |
| 5,634,803 | 6/1997 | Cheng et al. | 439/160 |
| 5,730,611 | 3/1998 | Cheng et al. | 439/160 |

*Primary Examiner*—Gary F. Paumen
*Attorney, Agent, or Firm*—Wei Te Chung

[57] ABSTRACT

A card edge connector in accordance with the present invention comprises an elongate housing defining a slot between opposite side walls thereof for receiving a daughter board therein, a plurality of contacts received in passageways defined in the side walls for electrically contacting golden fingers formed on opposite outer surfaces of a bottom edge of the daughter board, and a pair of ejectors mounted to opposite ends of the housing for positioning and ejecting the daughter board from the card edge connector. Each ejector comprises a body for engaging with the housing, a pair of clasps extending from an upper edge of the body for retaining a lateral edge of the daughter board, and a head portion for engaging within a notch defined in corresponding lateral edge of the daughter board. A thin rib downwardly extends from a bottom surface of the head portion for firmly abutting against a lower inner surface of the corresponding notch of the daughter board thereby preventing vertical movement of the daughter circuit board.

9 Claims, 5 Drawing Sheets

CARD EDGE CONNECTOR

BACKGROUND OF THE INVENTION

The present invention relates to a card edge connector for interconnecting a daughter circuit board and a mother circuit board, and particularly to a card edge connector having an ejecting mechanism which ensures that the daughter board is securely fixed to the card edge connector.

Pertinent card edge connectors are disclosed in Taiwan Patent Application Nos. 81110052 and 84209392, and U.S. Pat. No. 5,364,282. Referring to FIG. 1, a conventional card edge connector commonly comprises an elongate housing 9 defining a slot 8 for receiving a bottom edge of a daughter circuit board 6, a plurality of contacts (not labeled) received in cavities (not shown) defined in opposite side walls of the housing 9 for engaging with the daughter board 6, and an ejector 7 mounted on a lateral end of the housing 9 for ejecting the daughter board 6 from the slot 8. The daughter board 6 defines a notch 60 in a lateral edge thereof for engaging with the ejector 7. The ejector 7 comprises a head 70 for engaging with a lower inner surface of the notch 60 of the daughter board 6 thereby fixing the daughter board 6 to the housing 9.

However, due to slight discrepancies in manufacturing parameters a length of the daughter board 6 from the bottom edge to the notch 60 may not properly correspond with a length from a bottom end of the ejector 7 to the head 70. That is to say, the head 70 of the ejector 7 may not exactly abut against the lower inner surface of the notch 60 of the daughter board 6, while a small clearance 80 is defined between the head 70 and the lower inner surface of the notch 60. The clearance 80 permits slight vertical movement of the daughter board 6 relative to the card edge connector. Thus, the daughter board 6 is not steadily fixed by the ejector 7 whereby unreliable signal transmission may result.

BRIEF SUMMARY OF THE INVENTION

A main object of the present invention is to provide a card edge connector having an ejecting mechanism for ensuring that a daughter circuit board is securely fixed to the card edge connector thereby achieving excellent electrical communication between the daughter board and a mother board on which the card edge connector is mounted.

A card edge connector in accordance with the present invention comprises an elongate housing defining a slot between opposite side walls thereof for receiving a daughter board therein, a plurality of contacts received in cavities defined in the side walls for engaging with the daughter board, and an ejecting mechanism including ejectors mounted to opposite lateral ends of the housing for locking the daughter board in position. The housing forms a pair of engaging portions on the opposite ends thereof for engaging with the daughter board and the corresponding ejectors. Each engaging portion comprises an inner receiving groove defined between opposite side walls thereof communicating with the slot, an outer cavity separated from the inner receiving groove by a partition, and a channel exposed to the side walls of the housing for receiving a corresponding board lock therein.

Each ejector comprises a body forming a pair of protrusions on opposite outer surfaces thereof for interferentially engaging within the corresponding receiving groove, a pair of clasps extending from the body for retaining a lateral edge of the daughter board thereby preventing horizontal movements of the daughter board, and a head portion upwardly extending from the clasps for engaging with the daughter board. A pair of trunnions is formed on the opposite outer surface of the body for pivotally engaging within the receiving groove of the corresponding engaging portion.

A thin rib downwardly extends from a bottom surface of the head portion for abutting against a lower inner surface of the corresponding notch. Therefore, the clasps restrict horizontal movement of the daughter board, while the thin rib prevents the daughter board from vertical movement. The rib of each ejector acts as a compensation when there exists a clearance between the head portion of the ejector and the notch due to manufacturing limitations for limiting the vertical movements of the daughter board. The rib of each ejector will intereferentially abut against an inner surface of the corresponding notch thereby securing the head portion with the daughter board.

Other objects, advantages and novel features of the invention will become more apparent from the following detailed description when taken in conjunction with the accompanying drawings.

DETAILED DESCRIPTION OF THE INVENTION

Figure 1:
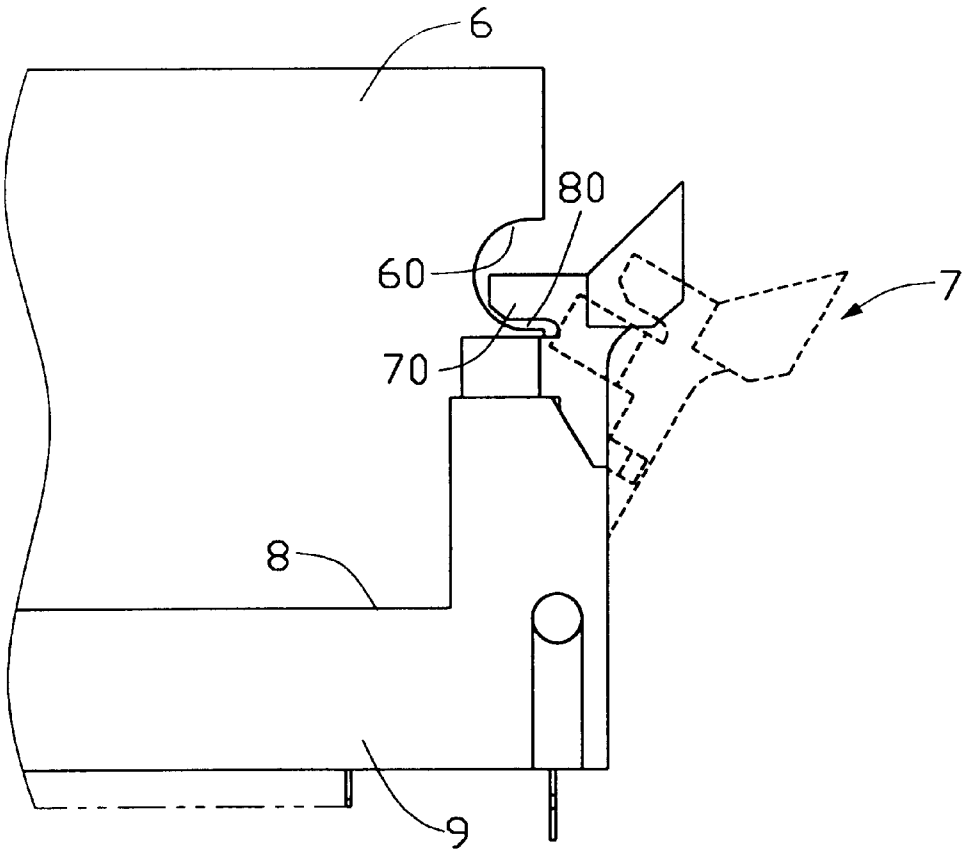
FIG. 1 (PRIOR ART)
FIG. 1 is a partial view of a conventional card edge connector assembled with a daughter board.
Figure 2:
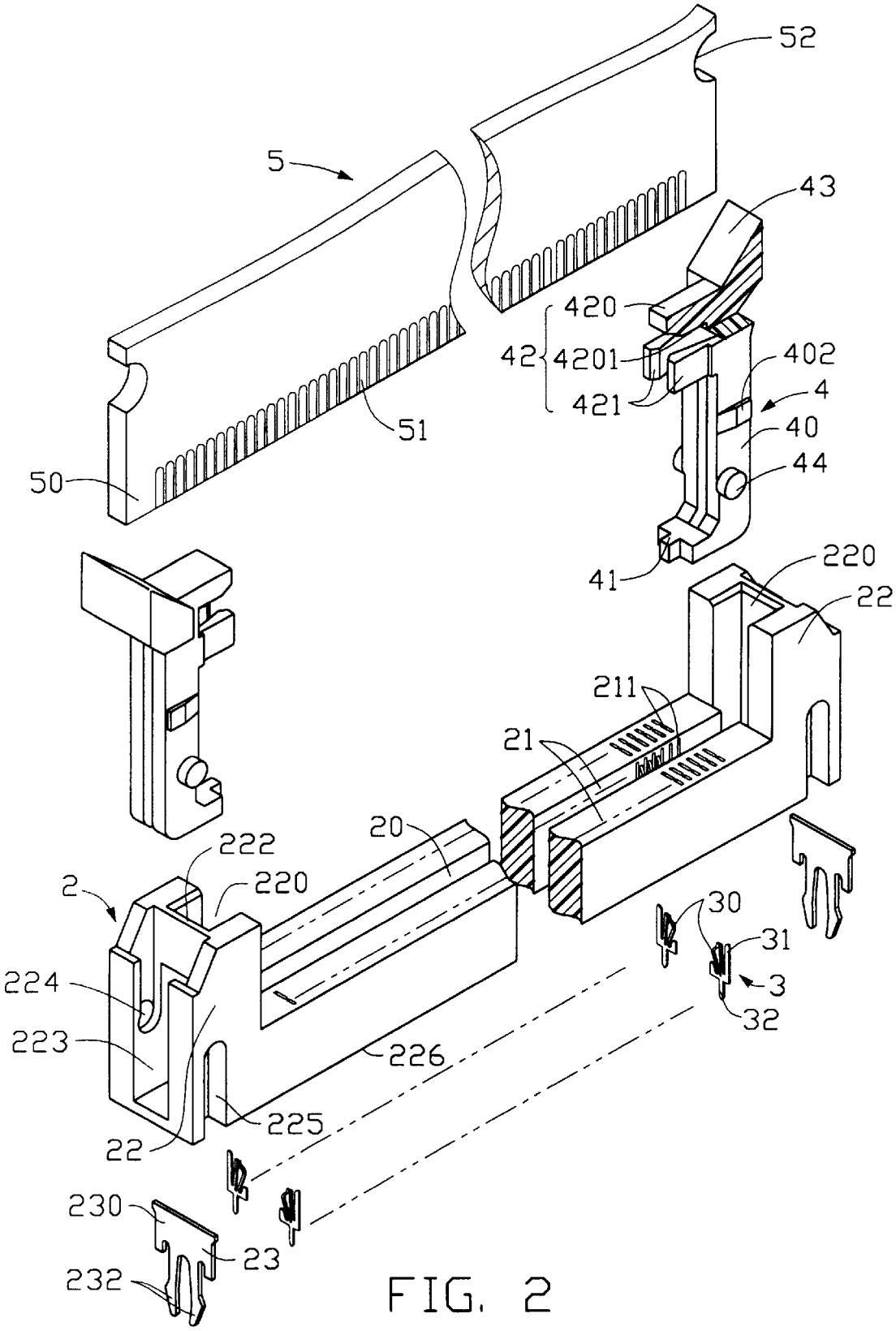
FIG. 2 is an exploded view of a card edge connector of the present invention and a daughter circuit board.

Referring to FIG. 2, a card edge connector in accordance with the present invention comprises an elongate housing 2 defining a slot 20 between opposite side walls 21 thereof for receiving a bottom edge 50 of a daughter board 5 therein, a plurality of contacts 3 received in passageways 211 defined in the side walls 21 communicating with the slot 20 for electrically engaging with corresponding golden fingers 51 formed on opposite outer surfaces of the bottom edge 50 of the daughter board 5, an ejecting mechanism comprising a pair of ejectors 4 for being fixed to the housing 2, and a pair of board locks 23 mounted to the housing 2.

The housing 2 forms a pair of engaging portions 22 on opposite ends thereof for engaging with the corresponding ejectors 4 and the corresponding board locks 23. Each engaging portion 22 comprises an inner receiving groove 220 for receiving a corresponding lateral edge of the daughter board 5, an outer cavity 223 for receiving the corresponding ejector 4 therein, a partition 222 separating the inner receiving groove 220 from the outer cavity 223, and a channel 225 exposed to outer surfaces of the side walls 21 and a bottom surface 226 of the housing 2. A pair of pivot holes 224 is defined in opposite inner surfaces (not labeled) of the side walls 21 in communication with the cavity 223.

Each contact 3 comprises a curved contact section 30 for contacting the corresponding golden finger 51, an engaging section 31 for engaging with the corresponding passageways 211 of the housing 2, and a soldering section 32 downwardly extending from the engaging section 31.

Each ejector 4 comprises a body 40, a head portion 42 upwardly extending from the body 40 for engaging with the daughter board 5, and a handle 43 outwardly extending from the head portion 42 for facilitating manual operation. A kicker 41 horizontally extends from the body 40 opposite the head portion 42 for ejecting the daughter board 5 inserted into the connector. A pair of protrusions 402 outwardly extends from opposite outer surfaces of the body 40 for interferentially fitting within the cavity 223. A pair of trunnions 44 outwardly extend from the opposite outer surfaces of the body 40 for pivotally engaging with the corresponding pivot holes 224 of the engaging portion 22. A pair of clasps 421 horizontally extending from an upper end of the body 40 for retaining the corresponding lateral edge of the daughter board 5.

The head portion 42 of each ejector 4 upwardly extending from an upper edge of the corresponding clasp 421 for engaging with a notch 52 defined in the corresponding lateral edge of the daughter board 5. A thin rib 4201 downwardly extends from a bottom surface of the head portion 42 for firmly abutting against a lower inner surface of the corresponding notch 52 thereby preventing vertical movements of the daughter board 5.

Figure 5:
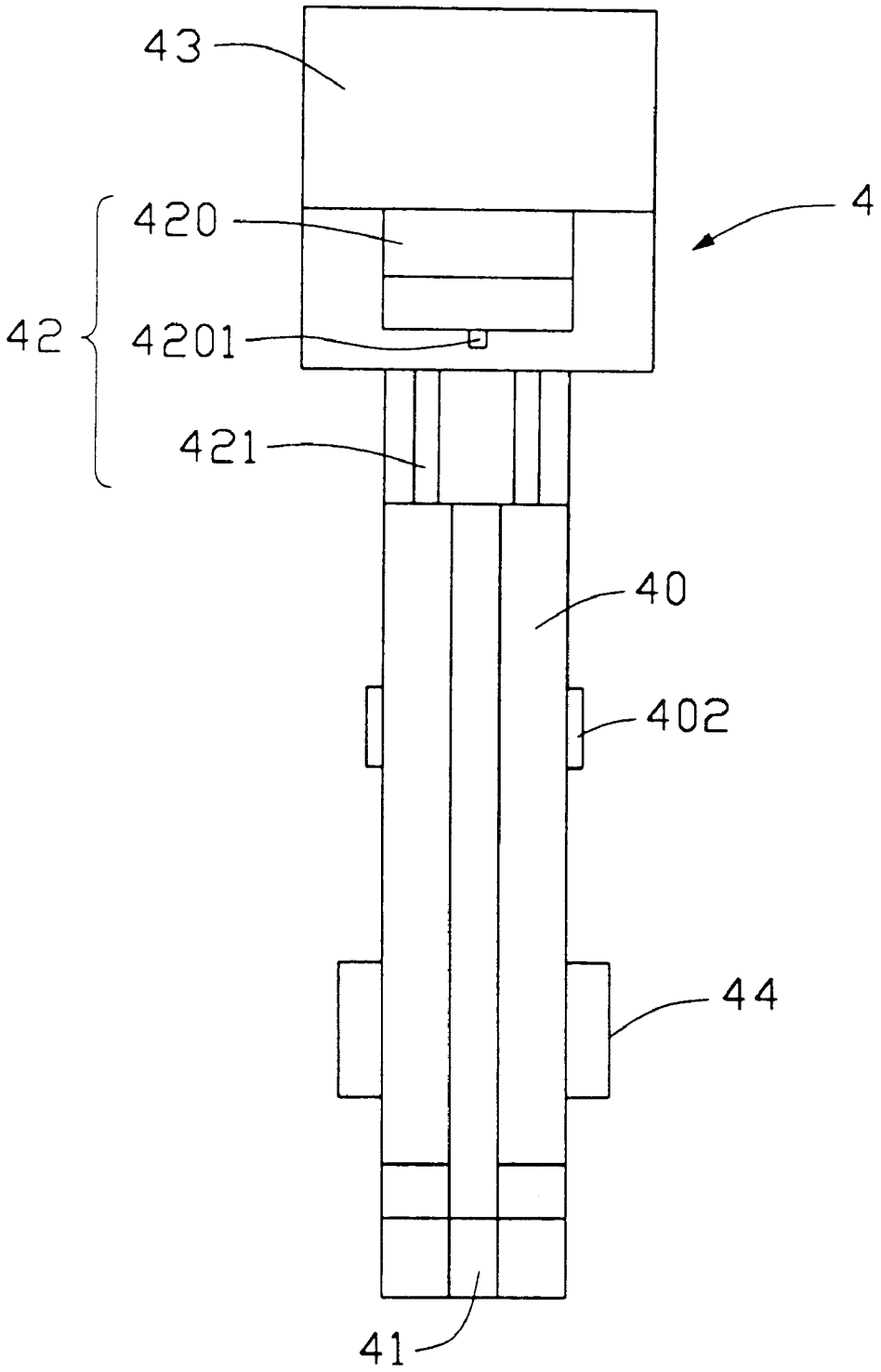
FIG. 5 is a side plan view of an ejector of FIG. 2.

Referring to FIG. 5, the rib 4201 of each ejector 4 has a width much smaller than a width of the head portion 42 for facilitating engagement with the corresponding notch 52 of the daughter board 5. The rib 4201 of each ejector 4 acts as a compensation when there exists a clearance between the head portion 42 of the ejector and the notch 52 due to manufacturing limitations for limiting the vertical movements of the daughter board 5. The rib 4201 of each ejector 4 will intereferentially abut against an inner surface of the corresponding notch 52 thereby securing the head portion 42 with the daughter board 5.

Each board lock 23 has a main plate 230 forming barbs (not labeled) on opposite lateral edges thereof for engaging with the channel 225 of the corresponding engaging portion 22, and a pair of legs 232 downwardly extending from the main plate 230 for connecting with a mother board (not shown).

Figure 3:
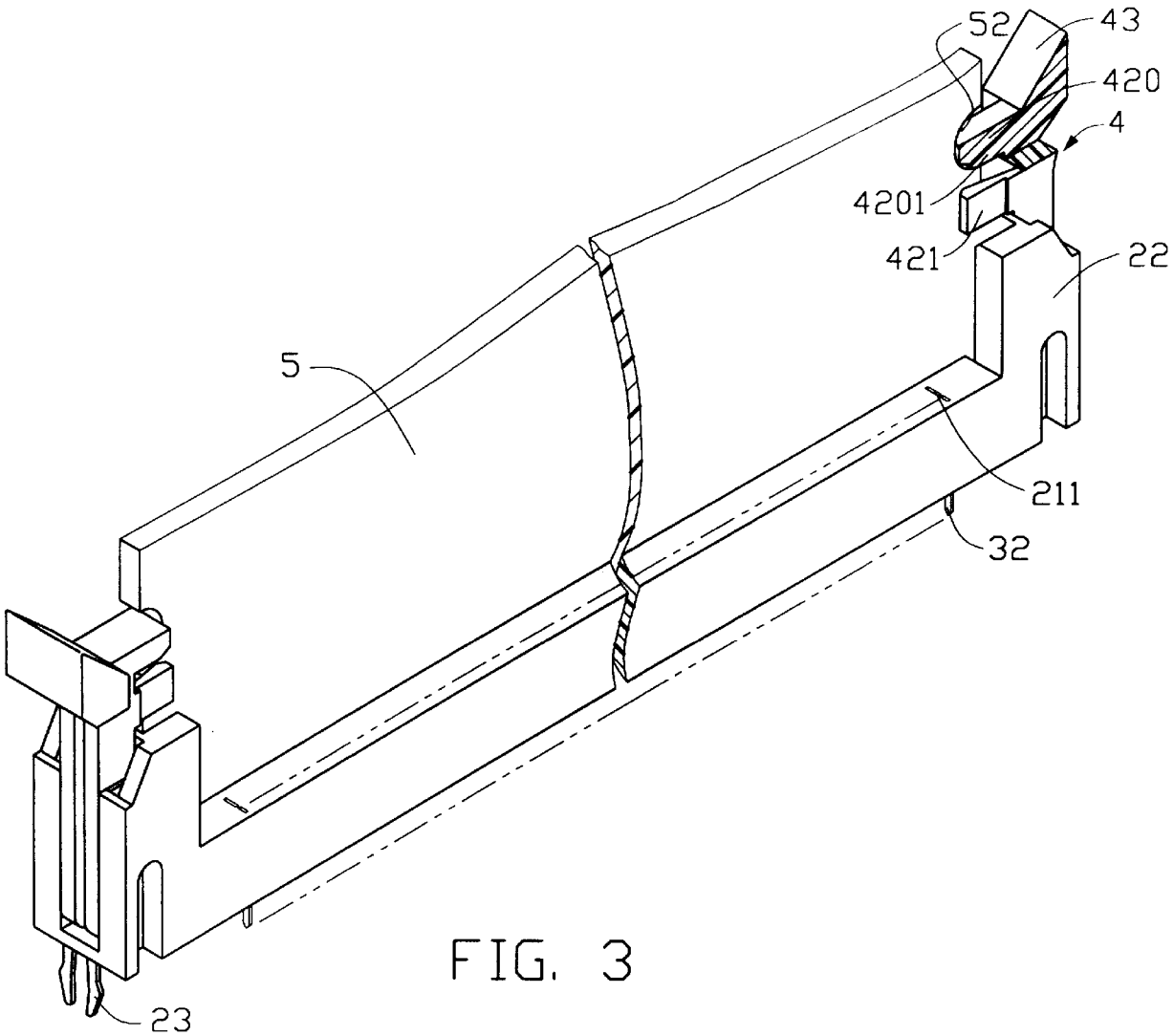
FIG. 3 is an assembled view of FIG. 2.
Figure 4:
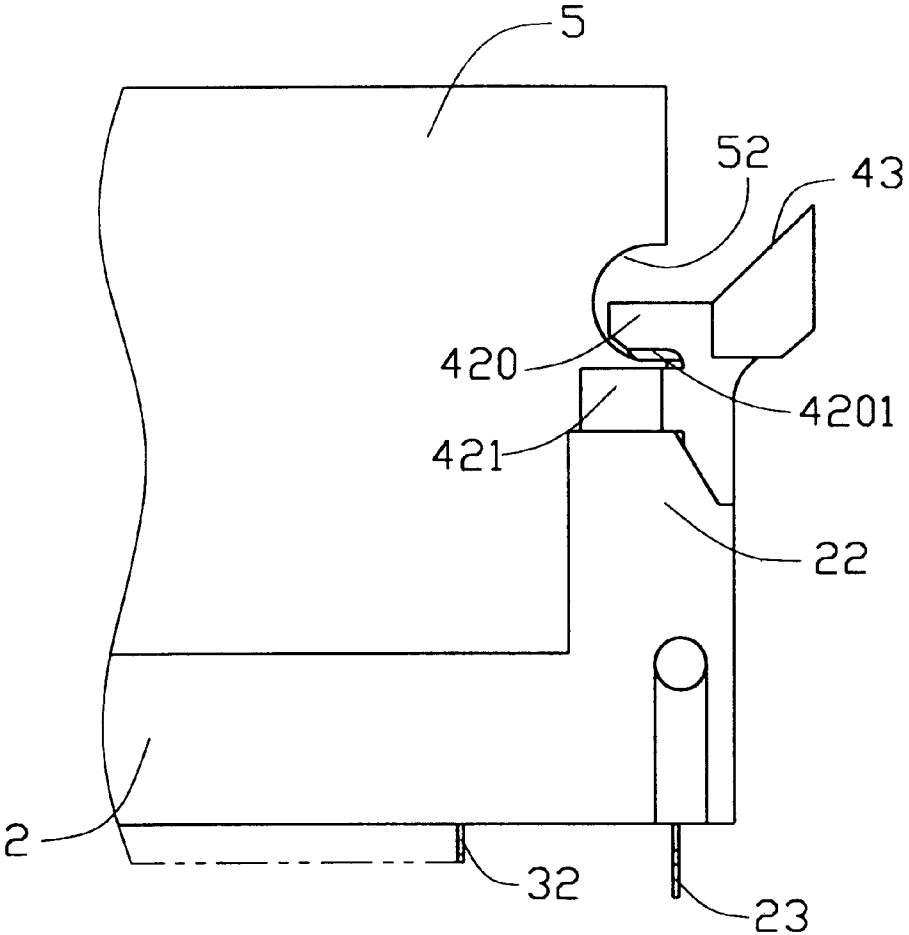
FIG. 4 is an enlarged partial front view of FIG. 3.

Referring further to FIGS. 3 and 4, after the contacts 3, the ejectors 4 and the board locks 23 are assembled to the housing 2, the card edge connector may be mounted to the mother board. The ejectors 4 are located at a first position and vertically extend from the engaging portions 22. When the daughter board 5 is moved toward the slot 20 of the housing 2, the ejectors 4 are driven to outwardly pivot about the trunnions 44 to allow insertion of the daughter board 5. At this point, the ejectors 4 are located at a second position. The daughter board 5 is then fully inserted into the slot 20 of the housing 2 and remains vertically disposed. The golden fingers 51 simultaneously contact the contact sections 30 of the corresponding contacts 3.

The ejectors 4 then return to the first position while simultaneously engaging with the daughter board 5. The clasps 421 retain the corresponding lateral edges of the daughter circuit board 5, while the head portions 42 engage within the corresponding notches 51 thereby preventing horizontal movements of the daughter circuit board 5. Due to the thin rib 4201 of each ejector 4, the corresponding head portion 42 firmly abuts against the lower inner surface of the corresponding notch 52 thus vertical movement of the daughter circuit board 5 is restricted.

When the daughter board 5 is to be withdrawn from the card edge connector, an external force is applied to the handles 43 of the ejectors 4 whereby the handles 43 are driven to outwardly pivot about the trunnions 44. The head portions 42 are then driven to disengage from the corresponding notches 52 of the daughter board 5, while the clasps 404 simultaneously disengage from the corresponding lateral edges of the daughter board 5, and the kickers 41 push upwardly a bottom edge of the daughter board. Thus, the daughter board 5 is ejected from the card edge connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for electrically connecting a daughter board, which has a notch in a lateral edge thereof and a plurality of golden fingers on opposite outer surfaces of a bottom edge thereof, with a mother circuit board, comprising:

an elongate dielectric housing forming a slot between opposite side walls thereof for receiving the daughter board, and a plurality of passageways in the side walls and communicating with the slot;

a plurality of contacts received in the passageways of the housing; and an ejector comprising a body and a head portion outwardly extending from an upper edge of the body for engaging with the notch of the daughter board, a thin rib being integrally extending downward from a bottom inner surface of the head portion for compensating clearance between the head portion of the ejector and corresponding notch of the daughter board and for abutting against an inner surface of the notch thereby securing the head portion with the daughter board.

2. The card edge connector as claimed in claim 1, wherein the rib of each ejector has a width much smaller than a width of the head portion for facilitating engagement with the notch of the daughter board.

3. The card edge connector as claimed in claim 1, wherein the housing comprises an engaging portion at an end thereof, the engaging portion comprising an inner receiving groove between the side walls in communication with the slot for receiving the lateral edge of the daughter board, a cavity for receiving the body of the ejector, and a partition separating the inner receiving groove and the cavity.

4. The card edge connector as claimed in claim 3, wherein the ejector forms a pair of trunnions on opposite outer surfaces of the body for allowing the ejector to pivot thereabout, and wherein the engaging portion defines a pair of pivot holes in opposite inner surfaces of the cavity for engaging with the trunnions of the ejector.

5. The card edge connector as claimed in claim 1, wherein a pair of clasps horizontally extends from an upper edge of the body for retaining the lateral edge of the daughter board thereby preventing horizontal movement of the daughter circuit board.

6. The card edge connector as claimed in claim 1, wherein the ejector further comprises a handle outwardly extending from the head portion for facilitating manual operation thereon.

7. The card edge connector as claimed in claim 1, wherein the ejector further comprises a kicker outwardly extending from the body opposite the head portion.

8. A card edge connector assembly comprising:

a card edge connector including an elongated dielectric housing forming a slot between two opposite side walls thereof;

a plurality of contacts disposed on two sides of the slot;

an ejector pivotally positioned at either end of the housing, said ejector defining a body with a locking head on a top portion thereof, said locking head horizontally extending toward the slot with a thin rib formed on a bottom inner surface of said locking head; and a daughter board defining a plurality gold fingers on opposite outer surfaces of a bottom edge thereof for engagement with the corresponding contacts when said daughter board is received within the slot, and a notch in either lateral edge; wherein a width of said locking head is larger than a thickness of the daughter board while a width of said rib is smaller than said thickness so that the locking head can efficiently hold the daughter board in position with regard to the housing under a condition that the rib tightly abuts against a lower inner surface of the notch of the daughter board for compensating clearance between the locking head and the notch.

9. An ejector for use with a card edge connector comprising:

a body;

a locking head extending horizontally from a top portion of the body;

a handle extending from said locking head in an opposite direction;

a kicker horizontally extending from a bottom portion of the body in a same direction with the locking head; and a thin rib formed on a bottom inner surface of said locking head and being much thinner than the locking head.

* * * * *